US010518135B2

(12) United States Patent
Evans et al.

(10) Patent No.: US 10,518,135 B2
(45) Date of Patent: Dec. 31, 2019

(54) SWIM PADDLE TRAINING DEVICE

(71) Applicant: Sports Engineering Group, LLC, Council Bluffs, IA (US)

(72) Inventors: Marc P. Evans, Council Bluffs, IA (US); Jane M. Cappaert, Council Bluffs, IA (US)

(73) Assignee: SPORTS ENGINEERING GROUP, LLC, Council Bluffs, IA (US)

( * ) Notice: Subject to any disclaimer, the term of this patent is extended or adjusted under 35 U.S.C. 154(b) by 0 days.

(21) Appl. No.: 15/788,422

(22) Filed: Oct. 19, 2017

(65) Prior Publication Data

US 2018/0133554 A1 May 17, 2018

Related U.S. Application Data

(60) Provisional application No. 62/410,308, filed on Oct. 19, 2016.

(51) Int. Cl.

| | |
|---|---|
| ***A63B 31/02*** | (2006.01) |
| ***A63B 31/10*** | (2006.01) |
| ***A63B 31/12*** | (2006.01) |

(52) U.S. Cl.

CPC ..... *A63B 31/10* (2013.01); *A63B 31/12* (2013.01); *A63B 2208/03* (2013.01); *A63B 2209/00* (2013.01); *A63B 2225/60* (2013.01); *A63B 2225/605* (2013.01); *A63B 2244/20* (2013.01)

(58) Field of Classification Search

CPC ..... A63B 31/02; A63B 31/04; A63B 31/08; A63B 31/10; A63B 31/18

See application file for complete search history.

(56) References Cited

U.S. PATENT DOCUMENTS

| | | | |
|---|---|---|---|
| 183,045 | A | 10/1876 | Dunlop |
| 950,633 | A | 3/1910 | Eastman |
| 1,971,844 | A | 8/1934 | Jackson |
| 3,417,415 | A | 12/1968 | John |
| RE28,855 | E | 6/1976 | Montrella |
| D262,477 | S | 12/1981 | Lewis |

(Continued)

OTHER PUBLICATIONS

Cappaert, et al., "Three-Dimensional Analysis of the Men's 100-m Freestyle During the 1992 Olympic Games", Journal of Applied Biomechanics; Human Kinetics Publishers, Inc., 1995, pp. 103-112.

Schleihauf, et al., "Propulsive Techniques: Front Crawl Stroke, Butterfly, Backstroke, and Breaststroke", Swimming Science V, International Series of Sport Sciences, vol. 18, 1988, pp. 53 - 59.

Smith, "The Illustrated Guide to Aerodynamics", Tab Books Inc., 1985, pp. 10-29 and 44-45.

(Continued)

*Primary Examiner* — Andrew Polay

(74) *Attorney, Agent, or Firm* — Dorsey & Whitney LLP

(57) ABSTRACT

A swim paddle training device is provided. The swim paddle may include opposing upper and lower sides or surfaces; front, rear, left, and right edges extending between or bounding the upper and lower sides; and a plurality of surface features arranged to facilitate proper movement of the swim paddle during swim training. The plurality of surface features may create areas of varying buoyancy to affect the orientation of the swim paddle during swim training, such as promoting a forward, downward, and inward pathway or rotation of the swim paddle during use. The plurality of surface features may include a plurality of grooves defined within at least the lower surface of the swim paddle.

17 Claims, 5 Drawing Sheets

(56) References Cited

U.S. PATENT DOCUMENTS

| | | | | |
|---|---|---|---|---|
| 4,316,300 | A * | 2/1982 | Lewis | A63B 31/08 441/59 |
| 4,721,300 | A | 1/1988 | Guzman | |
| 4,913,418 | A | 4/1990 | Schlueter et al. | |
| 5,147,233 | A * | 9/1992 | Hannula | A63B 31/10 441/56 |
| 5,288,254 | A | 2/1994 | Elson | |
| 5,304,080 | A * | 4/1994 | Dilger | A63B 31/08 416/72 |
| 5,376,036 | A | 12/1994 | Hull | |
| D363,754 | S | 10/1995 | Johnson | |
| 5,634,834 | A | 6/1997 | Cole et al. | |
| 5,643,027 | A | 7/1997 | Evans et al. | |
| 5,810,630 | A | 9/1998 | Saghri | |
| 7,798,876 | B2 | 9/2010 | Mix | |
| 9,308,418 | B2 * | 4/2016 | Davis | A63B 31/10 |
| 2014/0141667 | A1 | 5/2014 | Dilorenzo et al. | |
| 2016/0107731 | A1 | 4/2016 | Chen | |

OTHER PUBLICATIONS

U.S. Appl. No. 29/581,522, Oct. 19, 2016.
U.S. Appl. No. 15/788,413, Oct. 19, 2017.
Author Unknown, "Strokemakers" Speedshop Int'l, Inc., Feb. 2, 1996, 2 pages.
Author Unknown, "CatalystTM Advertisement", TYR Sport, Huntington Beach, CA 92649, Jan. 1996, 3 pages.
Donaldson, "A Sailor's Guide to Sails", Dodd, Mead & Company, 79 Madison Avenue, New York, NY 10016, 1984, pp. 4-7 and 36-41.
Hannula, "Effective Paddle Training", Source Unknown, May 1992, 5 pages.
Hannula, "Han's Paddles Brochure", Tacoma, WA, Feb. 2, 1996, 2 pages.
Hull, "Fulcrum High Speed Pull Paddles", Zoomers, Woodside CA, 1990, 3 pages.

* cited by examiner

SWIM PADDLE TRAINING DEVICE

CROSS REFERENCE TO RELATED APPLICATIONS

This application claims the benefit of priority under 35 USC § 119(e) of the earlier filing date of U.S. Provisional Patent Application No. 62/410,308 filed Oct. 19, 2016 and entitled "SWIM PADDLE TRAINING DEVICE," which is hereby incorporated by reference in its entirety.

TECHNICAL FIELD

The present disclosure relates generally to physical fitness, skill, and technique development and training and more specifically to a swim paddle training device.

BACKGROUND

Various devices and systems exist to perform a variety of swimming exercises. As an example, swim paddles exist to help increase swimming efficiency, create a more consistent feel for the water, help build better swim mechanics, and improve overall strength and technique of a swim athlete as part of a swimming program. Some paddles, however, can put strain on a swimmer's ligaments and tendons and fall short of teaching proper muscle activations and movement and thusly, may encourage bad training habits. For instance, some paddles may place a swimmer in a compromised swimming position, such as in an undesirable or unnatural biomechanical position. In addition, some paddles are ineffective at abducting (rotating outwards) and/or adducting (rotating inwards) the shoulder to promote a high elbow catch and water holding capacity.

It is therefore desirable to provide an improved swim paddle that addresses at least in part the above described problems and/or which more generally offers improvements or an alternative to existing arrangements.

SUMMARY

The present disclosure generally provides a swim paddle training device. The swim paddle is arranged to facilitate a desired or optimal load transfer, such as a pelvic load transfer, to promote proper swimming form and/or technique. For example, the paddle may be arranged to better transfer the load of muscular force from the pelvis to the arm and shoulder areas of a swimmer, which may be desirable to increase efficiency, water holding ability, and power of the swimmer for a particular swim stroke. In addition, the paddle may be sized and shaped to facilitate its movement through water, such as including one or more surface features orienting the paddle within the water, reducing drag, and/or promoting the hold onto and feel of the water during swim training. The paddle may be arranged to provide various amounts of flotation and/or buoyancy, and may be configured to traverse under, at, or on the surface of water. In some embodiments, the paddle may be adjustable to adapt to the needs of a swimmer's skill level and/or the swimming stroke being performed.

Embodiments of the present disclosure may include a swim paddle. The swim paddle may include opposing upper and lower surfaces; front, rear, left, and right edges bounding the upper and lower surfaces; and a plurality of grooves defined within the lower surface and extending from at least one of the front, rear, left, and right edges.

In some examples, at least a subset of the plurality of grooves may extend around the at least one of the front, rear, left, and right edges from the lower surface to the upper surface to define a plurality of ribs along the at least one of the front, rear, left, and right edges.

In some examples, the plurality of grooves may extend from the rear edge to at least one of the front, left, and right edges. The plurality of grooves may include a first plurality of grooves extending from the rear edge to at least one of the front, left, and right edges. The plurality of grooves may include a second plurality of grooves extending from one of the left and right edges to the interior of the lower surface. The plurality of grooves may include a third plurality of grooves extending from the front edge to the interior of the lower surface. The first plurality of grooves may extend generally along a length of the swim paddle between the front and rear edges. The second plurality of grooves may extend generally along a width of the swim paddle between the left and right edges.

In some examples, a plurality of depressions may be defined within the upper surface and may be arranged to receive at least a portion of a user's hand. The depressions may be sized and shaped to receive the fingers and thumb of a user's hand.

In some examples, an engagement mechanism may extend from the upper surface for engagement with a user's hand.

In some examples, a notch may be defined on the rear edge, the notch arranged to receive a portion of a user's forearm during use.

Embodiments of the present disclosure may include a swim paddle. The swim paddle may include opposing upper and lower sides; front, rear, left, and right edges extending between the upper and lower sides; and a plurality of surface features arranged to facilitate proper movement of the swim paddle during swim training.

In some examples, the plurality of surface features may be defined in at least one of the upper and lower sides.

In some examples, the plurality of surface features may include a first plurality of grooves extending generally along a length of the swim paddle between the front and rear edges, and a second plurality of grooves extending generally along a width of the swim paddle between the left and right edges. The plurality of surface features may include a third plurality of grooves extending from the front edge to the interior of the swim paddle. At least one of the first, second, and third pluralities of grooves may define a plurality of ribs on at least one of the front, rear, left, and right edges. The first plurality of grooves may define a first plurality of ribs on the rear edge. The second plurality of grooves may define a second plurality of ribs on one of the left and right edges. The third plurality of grooves may define a third plurality of ribs on the front edge.

In some examples, the plurality of surface features may include a notch defined on the rear edge, the notch arranged to receive a portion of a user's forearm during use.

In some examples, the plurality of surface features may include a plurality of depressions defined within the upper side and arranged to receive at least a portion of a user's hand during use.

In some examples, an engagement mechanism may extend from the upper side to engage the swim paddle to a user's hand. The engagement mechanism may be a T-post.

In some examples, the paddle may be asymmetrical across a width of the paddle defined between the left and right edges.

Additional embodiments and features are set forth in part in the description that follows, and will become apparent to those skilled in the art upon examination of the specification and drawings or may be learned by the practice of the disclosed subject matter. A further understanding of the nature and advantages of the present disclosure may be realized by reference to the remaining portions of the specification and the drawings, which forms a part of this disclosure.

One that is skilled in the art will understand that each of the various aspects and features of the disclosure may advantageously be used separately in some instances, or in combination with other aspects and features of the disclosure in other instances. Accordingly, while the disclosure is presented in terms of embodiments, it should be appreciated that individual aspects of any embodiment can be claimed separately or in combination with aspects and features of that embodiment or any other embodiment. The present disclosure of certain embodiments is merely exemplary in nature and is in no way intended to limit the claimed invention or its applications or uses. It is to be understood that other embodiments may be utilized and that structural and/or logical changes may be made without departing from the spirit and scope of the present disclosure.

The present disclosure is set forth in various levels of detail in this application and no limitation as to the scope of the claimed subject matter is intended by either the inclusion or non-inclusion of elements, components, or the like in this summary. In certain instances, details that are not necessary for an understanding of the disclosure or that render other details difficult to perceive may have been omitted. Moreover, for the purposes of clarity, detailed descriptions of certain features will not be discussed when they would be apparent to those with skill in the art so as not to obscure the description of the present disclosure. It should be understood that the claimed subject matter is not necessarily limited to the particular embodiments or arrangements illustrated herein, and the scope of the present disclosure is defined only by the appended claims.

BRIEF DESCRIPTION OF THE DRAWINGS

The description will be more fully understood with reference to the following figures in which components may not be drawn to scale, which are presented as various embodiments of the swim paddle training device described herein and should not be construed as a complete depiction of the scope of the swim paddle.

DETAILED DESCRIPTION

Figure 2:
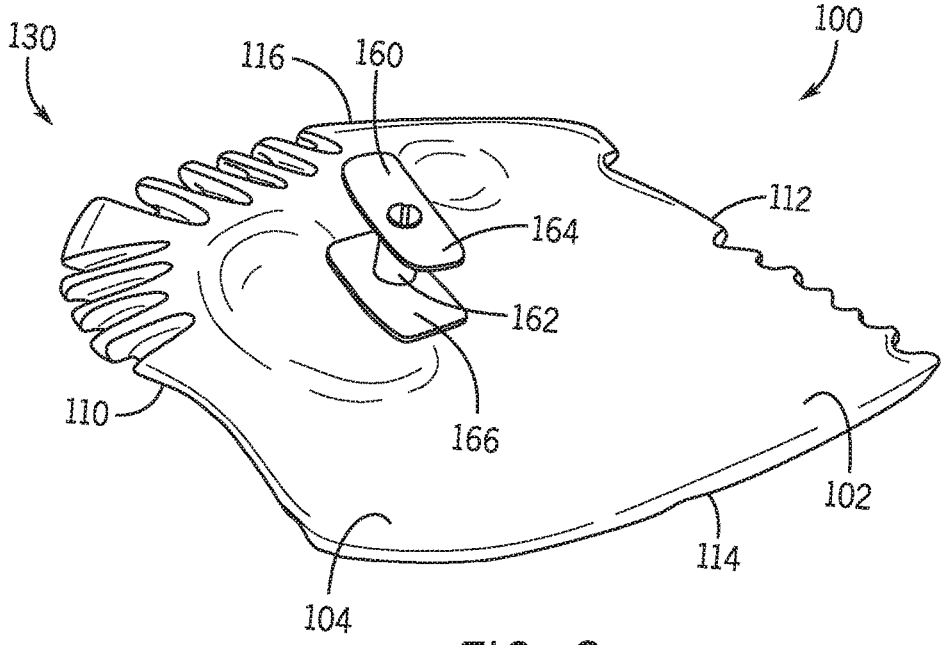
FIG. 2 is a top front isometric view of the swim paddle of FIG. 1.
Figure 3:
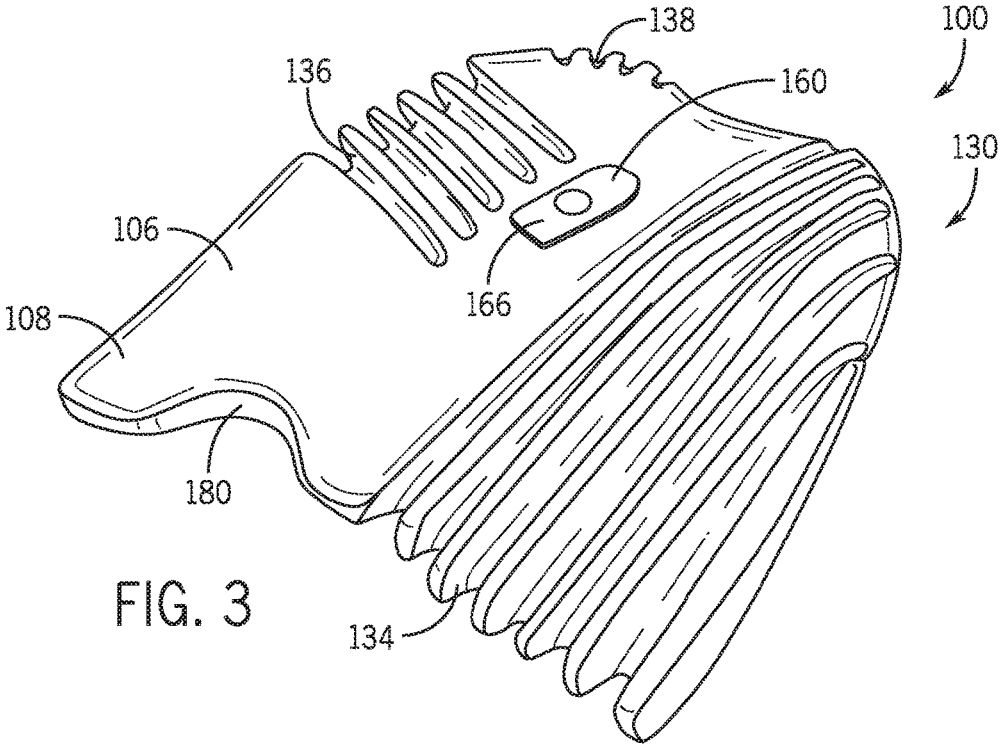
FIG. 3 is a bottom rear isometric view of the swim paddle of FIG. 1.
Figure 4:
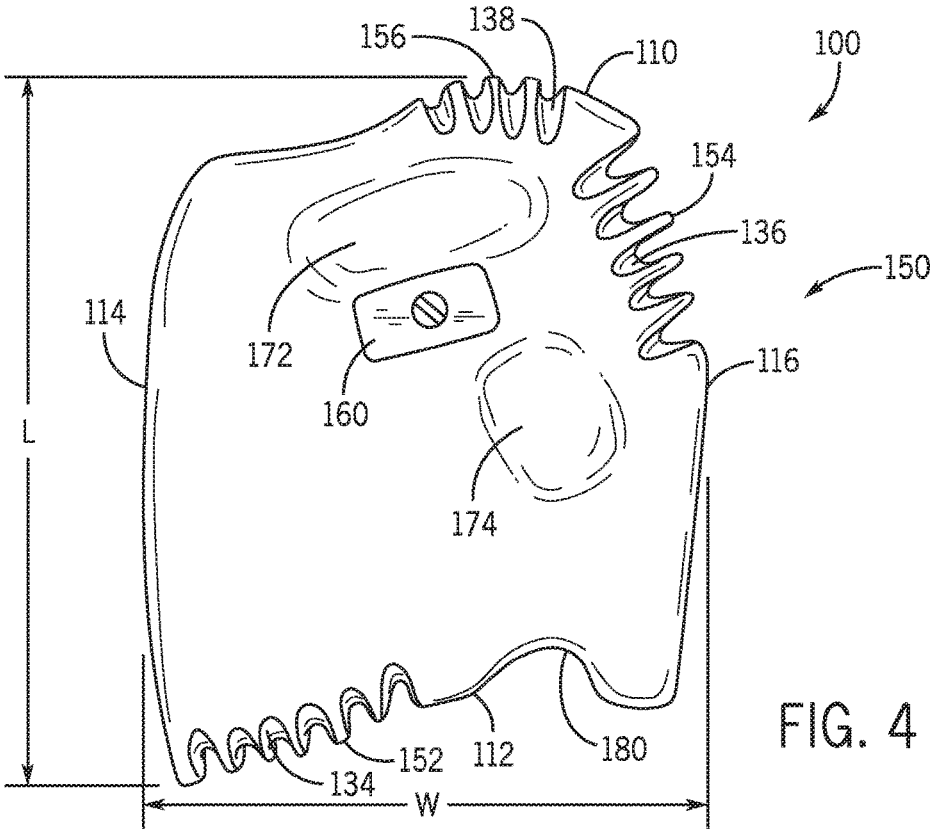
FIG. 4 is a top plan view of the swim paddle of FIG. 1.

FIGS. 1-7 illustrate an exemplary embodiment of a swim paddle 100. As shown, the paddle 100 may include an upper side 102 defining an upper surface 104 (see FIG. 1), a lower side 106 defining a lower surface 108 (see FIG. 3), and front, rear, left, and right edges 110, 112, 114, 116 extending between the upper and lower sides 102, 106 (see FIG. 2), such as bounding the upper and lower surfaces 104, 108. As shown in FIG. 4, the paddle 100 includes a length L extending between the front and rear edges 110, 112, and a width W extending between the left and right edges 114, 116. Depending on the particular application, the length L may be greater than the width W, less than the width W, or approximately equal to the width W. In some embodiments, the length L may be between about 150 mm and about 310 mm (preferably about 230 mm). The width W may be between about 120 mm and about 290 mm (preferably about 205 mm). In some embodiments, the paddle 100 may be sized and shaped depending on the particular age, skill level, or size, among others, of a user. For example, the paddle 100 (e.g., the length L and/or the width W) may be sized smaller for youth users compared to adult users, such as being about 25-50% smaller, about 50% smaller, greater than 50% smaller, or the like.

As explained below, the paddle 100 (e.g., the upper surface 104, the lower surface 108, and each of the front, rear, left, and right edges 110, 112, 114, 116) may be arranged for improved pelvic load transfer of deeper core muscles for energy transfer to the limbs and/or hydrodynamics, such as improved movement, stability, flotation, or the like. For instance, the paddle 100 may be sized and shaped for specific movement within or on the water, as explained more fully below. In one embodiment, each of the front, rear, left, and right edges 110, 112, 114, 116 may be arcuately shaped to, for instance, define the flow of fluid adjacent or about the paddle 100. Similarly, each of the upper and lower surfaces 104, 108 may be arranged (e.g., curved) to improve the hydrodynamics of the paddle 100, such as reducing the amount of drag associated with the paddle 100 gliding through water. In some embodiments, the upper and lower surfaces 104, 108 may be spaced apart in a hydrofoil design. For example, the paddle 100 may be arranged such that fluid passes over the top of the paddle 100 at a different speed compared to the fluid passing below the paddle 100. In one embodiment, the fluid passing above the paddle 100 may travel at a speed greater than the fluid passing under the paddle 100 to provide a degree of hydrodynamic lift. In this manner, the paddle 100 may be arranged to provide a degree of pelvic load energy transfer to a user, such as delivering energy proximally to the distally supporting the user's arm(s) and legs. The hydrofoil arrangement of the paddle 100 may be configured to position the paddle 100 at a particular location within the water, such as at the surface of the water, immediately below the surface of the water, at a desired distance below the surface of the water (e.g., about 5 cm to about 15 cm below the surface of the water), or the like. Additionally or alternatively, the paddle 100 may rely on the buoyancy of its material and/or construction to provide the desired flotation or position within the water, as explained below. The paddle 100 may be arranged for either left or right hand use. FIGS. 1-7 illustrate a paddle 100 designed for left hand use. A paddle designed for right hand use may be a mirror image of the paddle 100 shown in FIGS. 1-7. For clarity, the following description relates to a left-handed paddle, thought the description applies to a right-handed paddle with appropriate modification.

In some embodiments, the paddle 100 may include a plurality of surface features 130 operable to facilitate proper movement of the paddle 100 during swim training. The surface features 130 may be defined in at least one of the upper side 102, the lower side 106, and the front, rear, left, and right edges 110, 112, 114, 116 of the paddle 100. In one embodiment, a plurality of grooves 132 is defined within at least the lower surface 108 of the paddle 100, the grooves 132 extending from at least one of the front, rear, left, and right edges 110, 112, 114, 116 (see FIG. 5). For example, the paddle 100 may include a first plurality of grooves 134 extending generally along the length L of the paddle 100, such as from the rear edge 112 to at least one of the front, left, and right edges 110, 114, 116. As shown, the first plurality of grooves 134 may be positioned adjacent one of the left or right edges 114 or 116 (e.g., adjacent the left edge 114 for a left-handed paddle 100) to promote proper swim form, as explained below. The paddle 100 may also include a second plurality of grooves 136 extending generally along the width W of the paddle 100, such as from one of the left and right edges 114, 116 (e.g., from the right edge 116) to an interior portion of the lower surface 108. In some embodiments, the paddle 100 may include a third plurality of grooves 138 extending from the front edge 110 to the interior portion of the lower surface 108. As shown, each of the first plurality of grooves 134 may be parallel and may be spaced apart equally from one another. In some embodiments, the width of each of the first plurality of grooves 134 may be substantially equal. Depending on the particular application, the groove width may vary or may be substantially constant along the length of each groove. To provide a desired aesthetic and/or functional characteristic, the depth of the first plurality of grooves 134 may vary or may be substantially constant along the length of each groove 134. For instance, the depth of the first plurality of grooves 134 may vary from shallow to deep from the front edge 110 to the rear edge 112, may vary from deep to shallow from the front edge 110 to the rear edge 112, or may remain approximately constant between the front and rear edges 110, 112. The second and third pluralities of grooves 136, 138 may be arranged similarly.

In the embodiments described herein, the grooves 132 defined within the lower surface 108 may facilitate proper movement of the paddle 100 through water. For example, the arrangement of the first plurality of grooves 134 may direct the flow of fluid adjacent the lower surface 108 of the paddle 100 substantially rearward, thereby reducing the amount of drag associated with the paddle 100 gliding longitudinally through water. In like manner, the second plurality of grooves 136 may direct the flow of fluid adjacent the lower surface 108 of the paddle 100 in the direction in which the paddle 100 is entering the water to allow a user to "catch and hold" the water during a swim stroke (e.g., the freestyle stroke). Additionally or alternatively, because the second plurality of grooves 136 extends at least partially transverse to the longitudinal length L of the paddle 100, the second plurality of grooves 136 may allow a user to "hold" the water while initiating the pull phase of a swim stroke. The third plurality of grooves 138 may be arranged similarly to direct the flow of fluid adjacent the front edge 110 of the paddle 100, as explained below.

Figure 5:
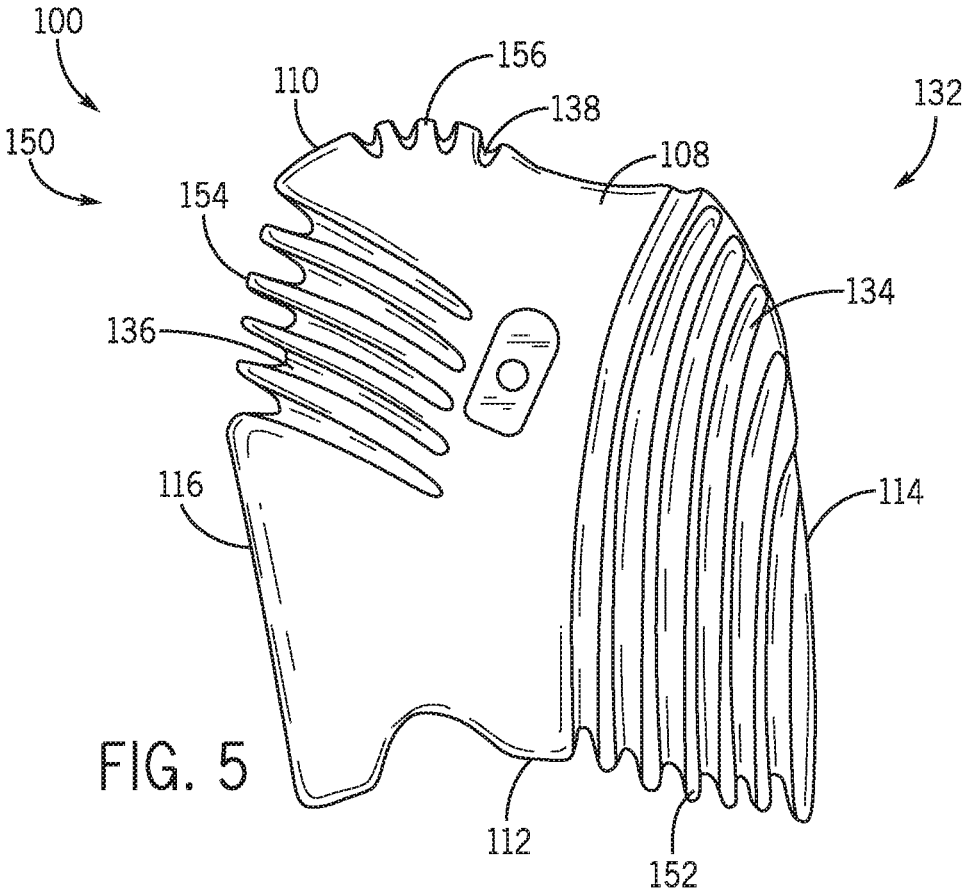
FIG. 5 is a bottom plan view of the swim paddle of FIG. 1.

Turning to FIGS. 4 and 5, the paddle 100 may include a plurality of notches or ribs 150 defined on at least one of the front, rear, left, and right edges 110, 112, 114, 116. The ribs 150 may be defined at least partially by a subset of the plurality of grooves 132 extending around the front, rear, left, or right edges 110, 112, 114, 116. For example, some or all of the first plurality of grooves 134 may be defined on the rear edge 112 such that the first plurality of grooves 134 may be considered to extend at least partially around the rear edge 112 to define a first plurality of ribs 152 on the rear edge 112. Similarly, some or all of the second plurality of grooves 136 may be defined on one of the left and right edges 114, 116 such that the second plurality of grooves 136 may be considered to extend at least partially around the left or right edge 114 or 116 to define a second plurality of ribs 154 on the respective edge. Some or all of the third plurality of grooves 138 may be defined on the front edge 110 such that the third plurality of grooves 138 may be considered to extend at least partially around the front edge 110 to define a third plurality of ribs 156 on the front edge 110. In such embodiments, the first, second, and third pluralities of ribs 152, 154, 156 may be contiguous with the portions of the lower surface 108 extending between the first, second, and third pluralities of grooves 134, 136, 138 defined therein. The first, second, and third pluralities of ribs 152, 154, 156 may be arranged for a desired aesthetic and/or functional characteristic, including reducing the amount of drag acting on the leading or trailing edges of the paddle 100. For example, each of the first, second, and third pluralities of ribs 152, 154, 156 may create a turbulent flow of fluid adjacent the edges of the paddle 100 to reduce the amount of drag at the corresponding edges. In this manner, the paddle 100 may enter and/or traverse through the water with reduced effort from a user. As such, the paddle 100 may better facilitate a user to feel and hold onto the water similar to swimming without the paddle 100.

In the embodiments described herein, the paddle 100 may be arranged to provide a desired stability and/or flotation characteristic to perform various swim training exercises. For instance, the paddle 100 may include a hydrofoil design arranged to provide a degree of lift and thereby, shaping of limb and body movement to the paddle 100. The upper and lower surfaces 104, 108 may be curved to facilitate fluid flow above, below, or around the paddle 100. In such embodiments, fluid passing above and below the paddle 100 may travel at different speeds, such as the fluid passing over the top of the paddle traveling at a speed greater than the fluid passing under the paddle 100, thus creating a degree of hydrodynamic lift.

The hydrofoil shaping and/or positioning of the grooves 132 and/or ribs 150 may facilitate proper movement of the paddle 100 and proper muscular activations for a particular swim stroke. For example, the hydrofoil shaping and/or positioning of the grooves 132 and/or ribs 150 may create more or less buoyancy at strategic locations to orient the paddle 100, and thus a user's hand, into proper position for proper swim form. As one example, the paddle 100 may be arranged to create more buoyancy on the outer or lateral side of the paddle 100 to promote a forward, downward, and inward pathway or rotation of the paddle 100. In such embodiments, the inward pathway of the paddle 100 may facilitate internal rotation (abduction/adduction) of a user's shoulder to promote a desirable high elbow catch and hold onto the water.

In addition or as an alternative to hydrofoil shaping, the paddle 100 may rely on the buoyancy of its material to provide the necessary flotation characteristic. For example, the lateral or outer portion of the paddle 100 may include a higher buoyancy compared to the medial or inner portion of the paddle 100 due to material selection and/or thickness. As such, the paddle 100 may be arranged to facilitate movement of the paddle 100 either below, on, or above the surface of water. In some embodiments, the hydrofoil design and/or buoyancy characteristics of the paddle 100 may be configured to provide a neutral buoyancy characteristic to the paddle 100. For instance, the paddle 100 may be sized and shaped such that the paddle 100 remains at the same position within the water regardless of the speed at which the paddle 100 is traversed through the water. In such embodiments, the paddle 100 may be arranged to reduce the tension on a user's shoulder, neck, and/or back regions and/or position the user in a more accurate or natural swimming position and muscular use. As such, the paddle 100 may be operable to increase the pelvic load and energy transfer of the user, reducing cervical and thoracic spine tension by lowering the angle of the arms and shoulders while raising the height of the hips and legs within the water. In this manner, the paddle 100 may improve swim efficiency and form by increasing pelvic load transfer.

Figure 6:
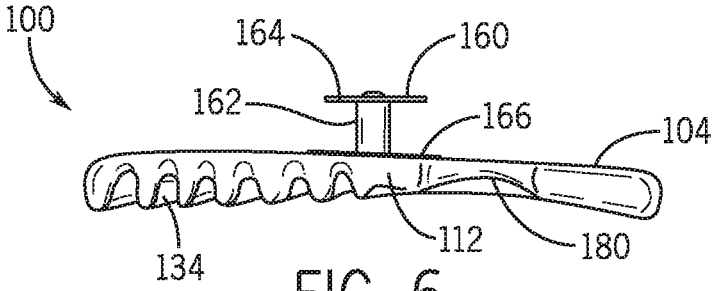
FIG. 6 is a rear elevation view of the swim paddle of FIG. 1.
Figure 7:
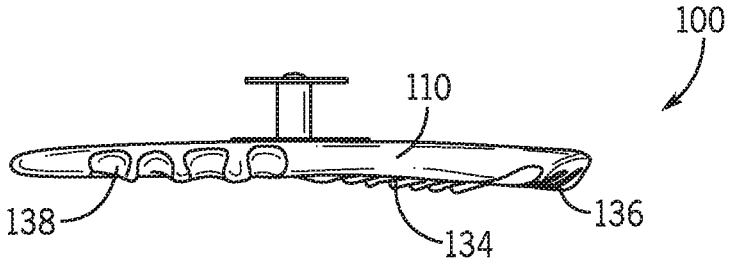
FIG. 7 is a front elevation view of the swim paddle of FIG. 1.
Figure 8:
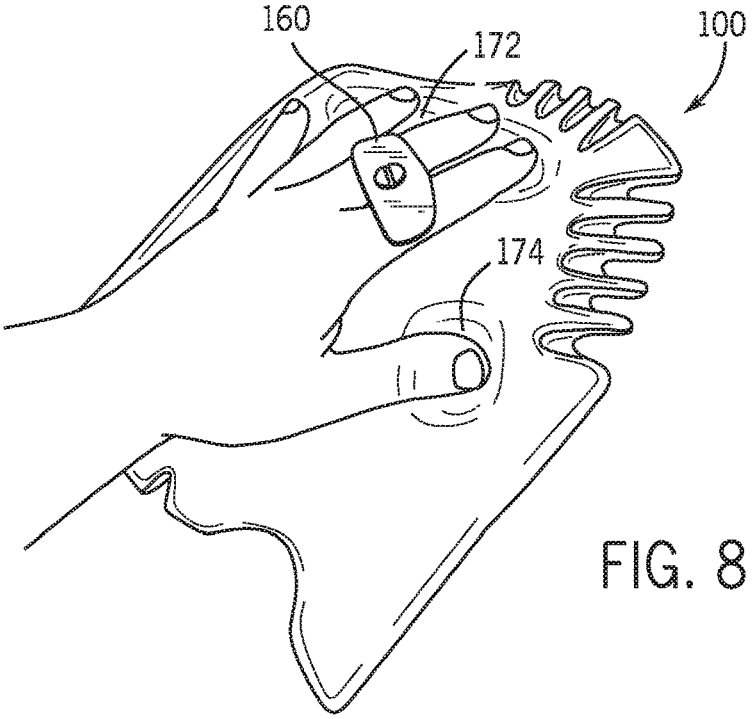
FIG. 8 is a perspective view of the swim paddle of FIG. 1 engaged to a user.

Turning to FIGS. 2, 3, and 6, the paddle 100 may include other features for convenience. For example, the paddle 100 may include an engagement mechanism 160 arranged to engage a user's hand. The engagement mechanism 160 may be coupled to a surface of the paddle 100, such as to the upper and lower surfaces 104, 108. As shown, the engagement mechanism 160 may be a T-post mechanism including a first member 162 coupled to the paddle 100 and a second member 164 connected to the first member 162 in a spaced relationship with the upper surface 104. The first member 162 may be coupled to the paddle 100 in substantially any manner, including being attached to the upper surface 104 or positioned within a cavity defined within or through the paddle 100, among others. In some embodiments, the first member 162 may include one or more tabs 166 arranged to engage at least one of the upper and lower surfaces 104, 108. The first member 162 and/or tab(s) 166 may be secured to the paddle 100 via adhesive, fasteners, heat or sonic welding, or the like. To at least allow the engagement mechanism 160 to engage a user's hand, the second member 164 may extend at an angle to the first member 162, such as substantially orthogonal. In some embodiments, the second member 164 may be rotatably coupled to an end of the first member 162 to, for instance, adjust the engagement mechanism 160 to a user's hand. During operation, the first member 162 may be positioned between two of the user's fingers, such as between the middle and ring fingers (see FIG. 8). Once engaged, the user's hand may be positioned between the upper surface 104 of the paddle 100 and the second member 164 of the engagement mechanism 160 to limit disengagement of the paddle 100 from the user's hand. The distance between the upper surface 104 of the paddle and the second member 164 may be adjustable (e.g., by swapping out first members 162 of different lengths) to fit a wide variety of hand dimensions. Similarly, the width of the second member 164 may be adjustable depending on user preference.

Figure 1:
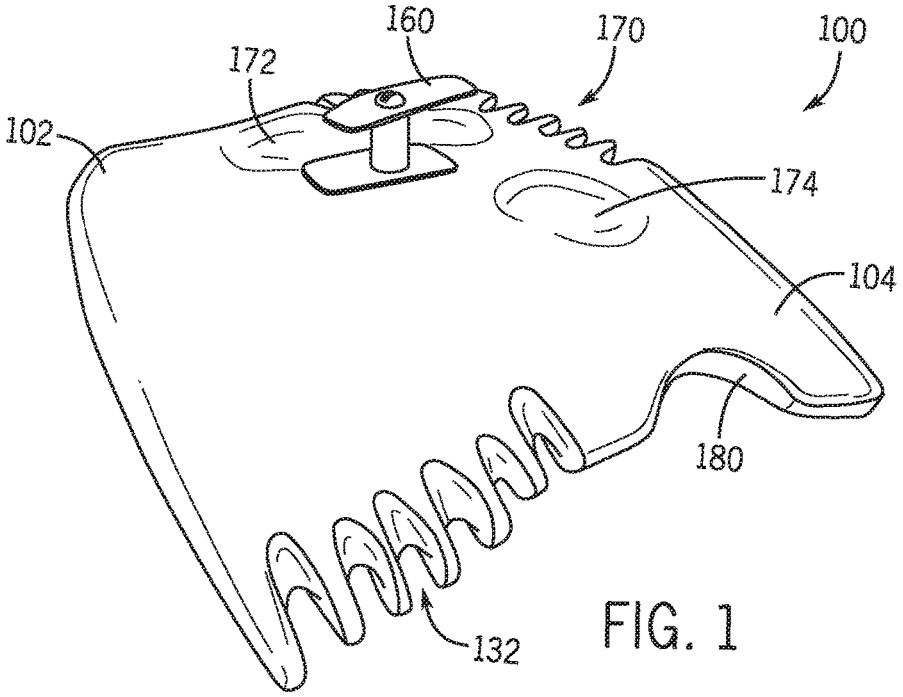
FIG. 1 is a top rear isometric view of a swim paddle.

Referring to FIGS. 1 and 4, the paddle 100 may include features allowing the paddle 100 to fit a user's hand. For instance, a plurality of depressions 170 may be defined within the upper surface 104 adjacent the engagement mechanism 160, the depressions 170 arranged to receive at least a portion of a user's hand. As shown, the paddle 100 may include a finger depression 172 defined adjacent the front edge 110 and a thumb depression 174 defined adjacent one of the left and right edges 114, 116 (e.g., the right edge 116 for a paddle 100 designed to be used with a user's left hand). During operation, at least a portion of a user's fingers may be positioned within the finger depression 172, and at least a portion of the user's thumb may be positioned within the thumb depression 174 (see FIG. 8). As such, the finger and thumb depressions 172, 174 may mimic the curvature of the user's hand, thereby allowing the paddle 100 to be comfortable and/or functional in a user's hand during operation. Additionally or alternatively, the finger and thumb depressions 172, 174 may permit a user to properly orient the paddle 100 for operation.

As shown in FIGS. 1, 3, and 4, the paddle 100 may include other features to permit operation of the paddle 100. For instance, the paddle 100 may include a cutout or notch 180 defined on the rear edge 112, such as adjacent the first plurality of ribs 152 defined on the rear edge 112. The notch 180 may be arranged to receive a portion of the user's forearm during operation. In this manner, the paddle 100 may include a length L greater than would be otherwise allowable. Additionally or alternatively, the front edge 110 may be positioned nearer a user's fingers for a given length L of the paddle 100.

Figure 9:
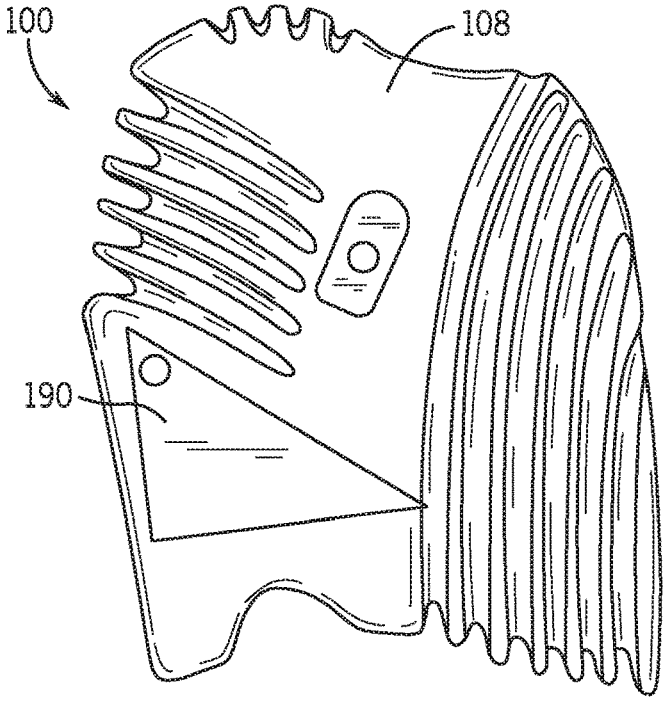
FIG. 9 is a bottom plan view of an additional swim paddle including one or more flaps to adjust a flotation characteristic of the paddle.
Figure 10:
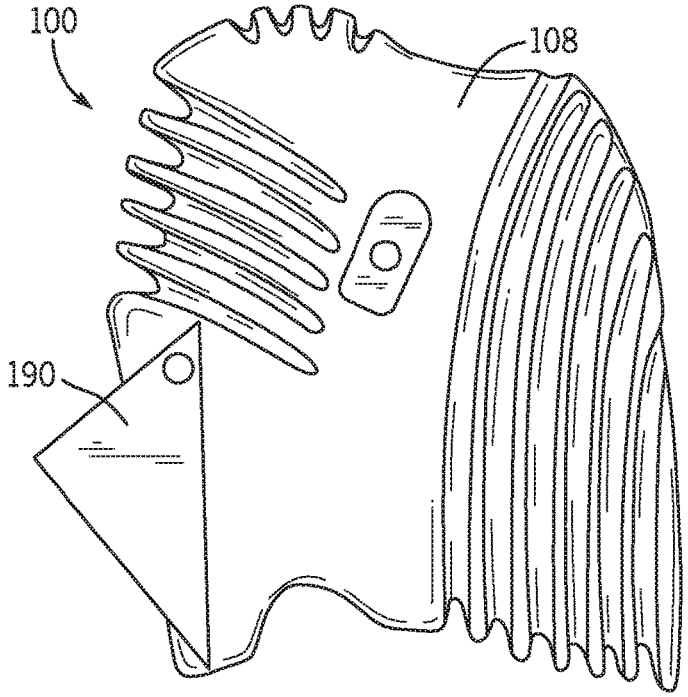
FIG. 10 is another bottom plan view of the swim paddle of FIG. 9 with the flap(s) adjusted to alter a flotation characteristic of the paddle.

Turning to FIGS. 9 and 10, the paddle 100 may be adjustable to accommodate users of different swimming abilities and/or alter the flotation characteristics to suit a particular swim stroke. In one embodiment, portions of the paddle 100 may articulate to alter the degree of flotation (i.e., lift) provided by the paddle 100. For example, portions of the paddle 100, such as one or more flaps 190, may articulate relative to the body of the paddle 100, such as rotating towards or away from the paddle 100, to reduce or increase the amount of lift and/or lateral stability provided by the paddle 100. The flap(s) 190 may be rotatably coupled to the paddle 100, such as to the lower surface 108 of the paddle 100. In the embodiments of FIGS. 9 and 10, rotating the flap(s) 190 away from the paddle 100 may increase the amount of lift provided by the lateral or outer portion of the paddle 100, promoting further internal rotation and adduction/abduction of the user's shoulder. Rotating the flap(s) 190 towards the paddle 100 may achieve similar results, such as reducing the amount of lift provided by the lateral or outer portion of the paddle 100 to reduce the amount of shoulder abduction (outward rotation) provided by the paddle 100. In this way, the paddle 100 may be tailored to a particular swim training program and/or desires of a user.

Though shown and described as asymmetrical, in some embodiments, the paddle 100 may be arranged symmetrically, such as across its width W, such that the paddle 100 may be used interchangeably with either the user's left or right hand. In such embodiments, flap 190 may be rotated relative the main body of the paddle 100 to promote the proper inward rotation of the paddle 100 for a particular swim stroke. For example, the flap 190 may be positioned to one side of the paddle 100 for use with a user's right hand. For use with a user's left hand, the flap 190 may be positioned to the opposite side of the paddle 100.

The paddle 100 may be formed from a variety of materials and means. For instance, the paddle 100 may be formed from a buoyant material, such as ethylene-vinyl acetate (EVA), foam, plastic, injection or compression molded rubber, or any other material promoting a desirable degree of floatation and/or rigidity. The paddle 100 may be formed in any suitable manner, such as by molding, extrusion, milling, die cutting, or the like. In some embodiments, at least a portion of the paddle 100 may be coated with a vinyl, a rubberized material, or any other coating for increased durability and/or waterproofing. The material may be selected for a desired buoyancy of the paddle 100. For example, the paddle 100 may be formed from a material that allows the paddle 100 to float at a position relative the surface of the water (e.g., on the surface of the water, just under the surface of the water, a few centimeters below the surface of the water, or the like), either unweighted or while loaded by a user during swim training.

In some embodiments, portions of the paddle 100 may be formed from materials of different buoyancy characteristics. For example, the left side of the paddle 100 may be formed from a first material, and the right side of the paddle 100 may be formed from a second material. The first and second materials may be configured such that the left side is more or less buoyant than the right side for the purposes explained above. Similarly, the portions of the paddle 100 adjacent the grooves 132 and/or depressions 170 may be more or less buoyant than other portions of the paddle 100 due to the difference in cross sectional thickness and/or material selection. In this way, the flotation characteristics may be customized depending on the particular application to, for instance, provide a desired load transfer between the paddle 100 and a user.

All relative and directional references (including: upper, lower, upward, downward, left, right, leftward, rightward, top, bottom, side, above, below, front, middle, back, vertical, horizontal, and so forth) are given by way of example to aid the reader's understanding of the particular embodiments described herein. They should not be read to be requirements or limitations, particularly as to the position, orientation, or use unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed:

1. A swim paddle comprising:
opposing upper and lower surfaces;
front, rear, left, and right edges bounding the upper and lower surfaces; and
a plurality of grooves defined within the lower surface and extending from at least one of the front, rear, left, and right edges, the plurality of grooves including:
a first plurality of grooves extending an entire length of the swim paddle between the front and rear edges; and
a second plurality of grooves extending from one of the left and right edges and terminating within the interior of the lower surface.

2. The swim paddle of claim 1, wherein the plurality of grooves create areas of varying buoyancy to affect the orientation of the swim paddle during swim training.

3. The swim paddle of claim 1, wherein the plurality of grooves promote a forward, downward, and inward pathway or rotation of the swim paddle during use.

4. The swim paddle of claim 1, wherein at least a subset of the plurality of grooves extends around the at least one of the front, rear, left, and right edges from the lower surface to the upper surface to define a plurality of ribs along the at least one of the front, rear, left, and right edges.

5. The swim paddle of claim 1, wherein the plurality of grooves includes:
a subset of grooves extending from the rear edge to at least one of the left and right edges; and
a third plurality of grooves extending from the front edge to and terminating within the interior of the lower surface.

6. The swim paddle of claim 1, further comprising a notch defined on the rear edge, the notch arranged to receive a portion of a user's forearm during use.

7. A swim paddle comprising:
opposing upper and lower sides;
front, rear, left, and right edges extending between the upper and lower sides;
a plurality of surface features configured to promote proper form when moving the swim paddle during swim training, the plurality of surface features defined on the upper side, the lower side, and at least one of the left and right edges to define a plurality of ribs on the front edge, the rear edge, and at least one of the left and right edges; and
wherein the plurality of surface features includes:
a first plurality of grooves extending generally along a length of the swim paddle between the front and rear edges; and
a second plurality of grooves extending generally along a width of the swim paddle between the left and right edges; and
a third plurality of grooves extending from the front edge and terminating within the interior of the swim paddle.

8. The swim paddle of claim 7, wherein the plurality of surface features create areas of varying buoyancy to affect the orientation of the swim paddle during swim training.

9. The swim paddle of claim 7, wherein at least one of the first, second, and third pluralities of grooves wrap around the edges of the swim paddle to define the plurality of ribs on the front edge, the rear edge, and at least one of the left and right edges.

10. The swim paddle of claim 9, wherein:
the first plurality of grooves defines a first plurality of ribs on the rear edge;
the second plurality of grooves defines a second plurality of ribs on one of the left and right edges; and
the third plurality of grooves defines a third plurality of ribs on the front edge.

11. The swim paddle of claim 7, wherein the plurality of surface features includes a notch defined on the rear edge, the notch arranged to receive a portion of a user's forearm during use.

12. The swim paddle of claim 7, wherein the plurality of surface features includes a plurality of depressions defined within the upper side and arranged to receive at least a portion of a user's hand during use.

13. The swim paddle of claim 7, wherein the swim paddle is asymmetrical across a width of the swim paddle defined between the left and right edges.

14. The swim paddle of claim 1:
wherein the upper and lower surfaces shaped and spaced apart to define a hydrofoil arrangement;
and
a plurality of ribs defined on the front edge, the rear edge, and at least one of the left and right edges.

15. The swim paddle of claim 14, wherein the hydrofoil arrangement, the plurality of grooves, and the plurality of ribs work together to create areas of varying buoyancy to affect the orientation of the swim paddle during swim training.

16. The swim paddle of claim 15, wherein the areas of varying buoyancy promote an inward pathway or rotation of the swim paddle during use to facilitate internal rotation of a user's shoulder to promote a high elbow catch swim technique.

17. The swim paddle of claim 14, wherein the hydrofoil arrangement, the plurality of grooves, and the plurality of ribs provide a neutral buoyancy characteristic of the swim paddle such that the swim paddle remains at a same position within the water regardless of the speed at which the paddle is traversed through the water.

* * * * *